United States Patent [19]

Juang

[11] Patent Number: 4,936,484

[45] Date of Patent: Jun. 26, 1990

[54] LIQUID CONTAINER

[76] Inventor: Ming J. Juang, 2 Fr, No. 18, Lane 136, Chung Ching N. Rd. Sec 3., Taipei, Taiwan

[21] Appl. No.: 231,530

[22] Filed: Aug. 12, 1988

[51] Int. Cl.[5] ..... B65D 51/16

[52] U.S. Cl. ..... 220/303; 220/85 SP; 222/527

[58] Field of Search ..... 220/85 SP, 303; 222/527, 526, 533

[56] References Cited

U.S. PATENT DOCUMENTS

| | | | |
|---|---|---|---|
| 1,838,468 | 12/1931 | Thomson | 222/475 |
| 2,516,728 | 7/1950 | Smith | 222/465.1 X |
| 4,125,207 | 11/1978 | Ernst et al. | 222/533 X |
| 4,269,332 | 5/1981 | Conn | 220/85 SP X |

FOREIGN PATENT DOCUMENTS

| | | | |
|---|---|---|---|
| 520423 | 6/1953 | Netherlands | 220/85 SP |

*Primary Examiner*—Stephen M. Hepperle

*Attorney, Agent, or Firm*—Ostrolenk, Faber, Gerb & Soffen

[57] ABSTRACT

An improved liquid container comprising an opening for filling in or pouring out liquid, an air hole extending from the handle, a small coupling cap, a big coupling cap and a flexible duct, said small coupling cap covering said air hole and removably connected with the flexible duct, said big coupling cap removably screwing with the opening and combined with the flexible duct by means of its central hole penetrated by the flexible duct and a round plate set at the bottom end of the duct for keeping said big cap on it, the opening communicating with the air hole through said duct for preventing leakage of the liquid after the container is filled full, said duct being separated from said small cap for pouring out liquid, and said big cap being separated from said opening for filling in liquid.

8 Claims, 4 Drawing Sheets

LIQUID CONTAINER

BACKGROUND OF THE INVENTION

The conventional liquid containers mostly have only one opening for filling in or pouring out its content, and the liquid can hardly be poured out smoothly because of the imbalance of the pressures inside and outside the container. Even if it has two openings, two caps of the openings have to be taken down so as to make the flowing out of the liquid smooth, and it is very possible that the removed caps may be lost or contaminated. In order to improve the defect mentioned above, the applicant has devised this invention.

SUMMARY OF THE INVENTION

This invention concerns an improved liquid container. It comprises an air hole extending horizontally from the handle, a flexible duct or a rotary duct that has its lower end to be connected with the opening of this container by means of a big coupling cap. The coupling cap is provided with a central round hole for the flexible duct to penetrate through upward, and with a female screw thread to screw with a male screw thread of the opening, and whereby the big coupling cap covers the opening. Besides, a round plate is connected with the lower end of the flexible duct to keep the big coupling cap on said duct from falling off. A small coupling cap has one of its ends to couple with the air hole in the handle and the other end screwing with the upper end of the flexible duct.

When a liquid is to be filled in the container, the big coupling cap is to be turned and removed from the opening, and when the liquid in the container is to be poured out, the upper end of the flexible duct is to be turned and separated from the small coupling cap.

The main features of this improved containers are 1. smooth flowing of the liquid out of the container, 2, possibility for adjusting the flowing out direction, and 3. no leaking of the liquid after the air hole and the opening communicates by connecting the small coupling cap, the flexible duct and the big coupling cap together.

DETAILED DESCRIPTION OF THE INVENTION

Figure 1:
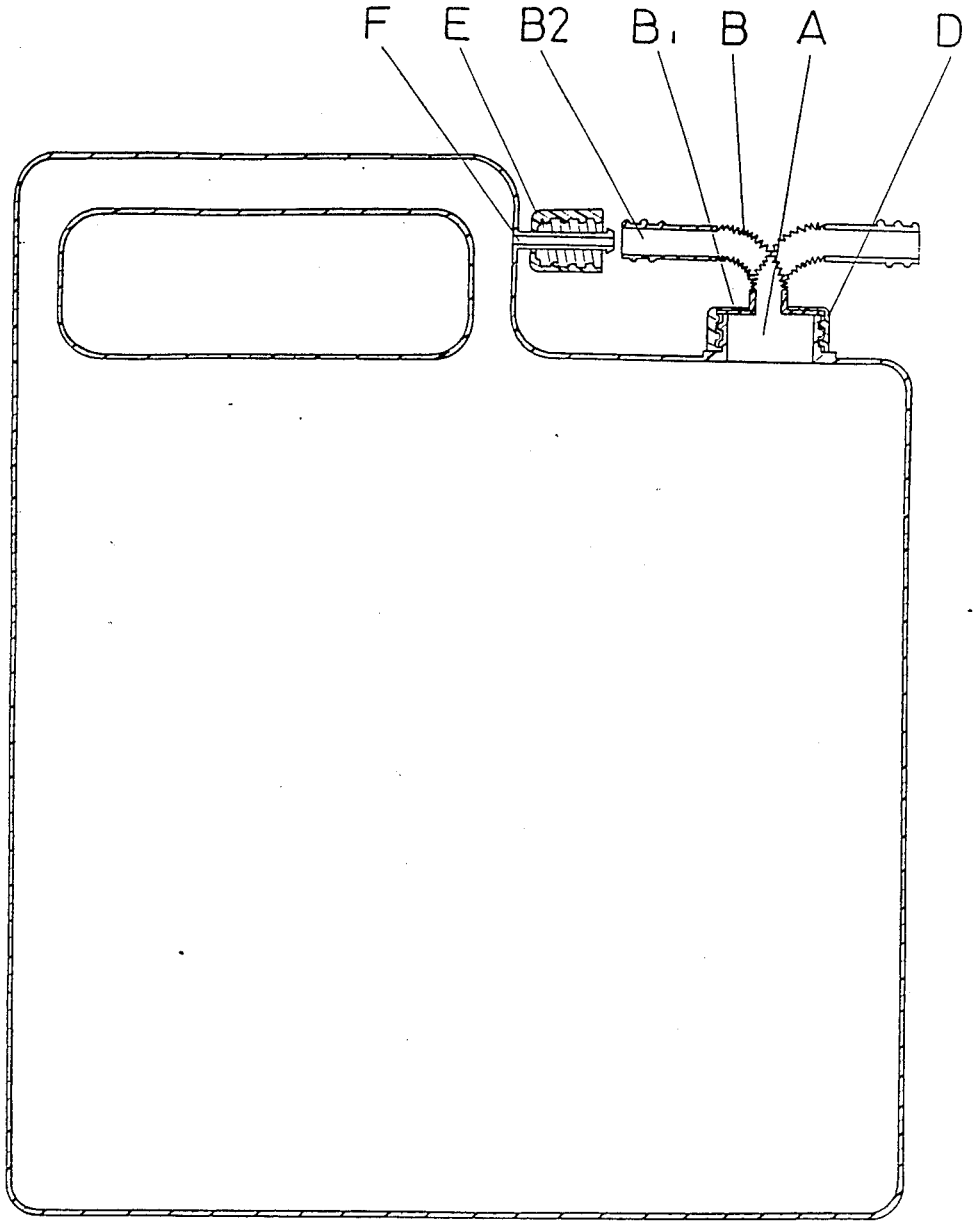
FIG. 1 is a side view of the improved liquid container in accordance with the present invention.
Figure 2:
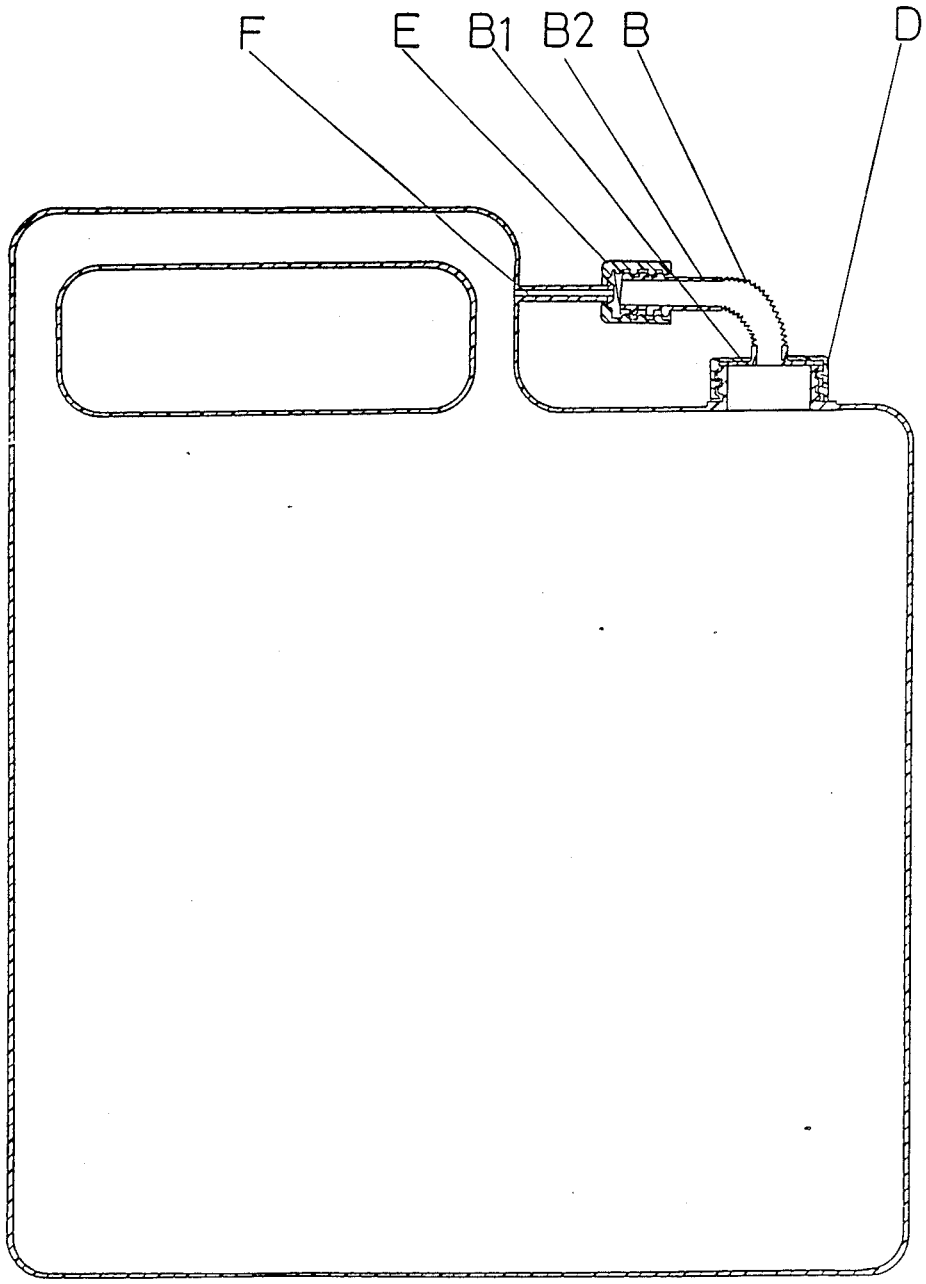
FIG. 2 is also a side view of the improved liquid container in accordance with the present invention.
Figure 3:
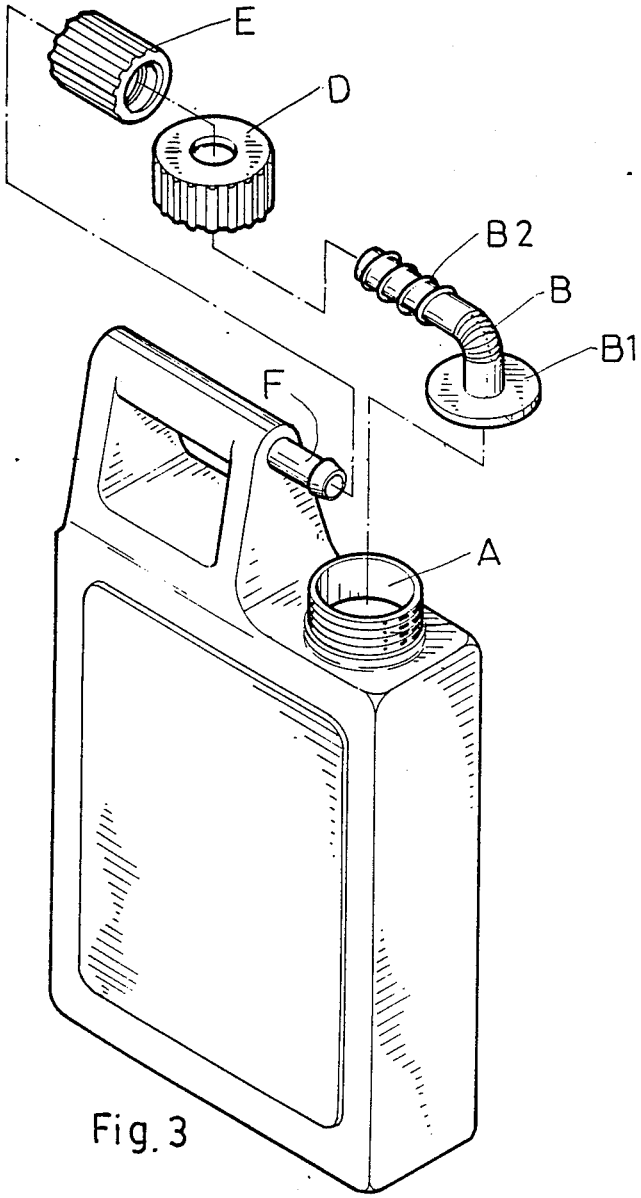
FIG. 3 is an exploded perspective view of the improved liquid container in accordance with the present invention.
Figure 4:
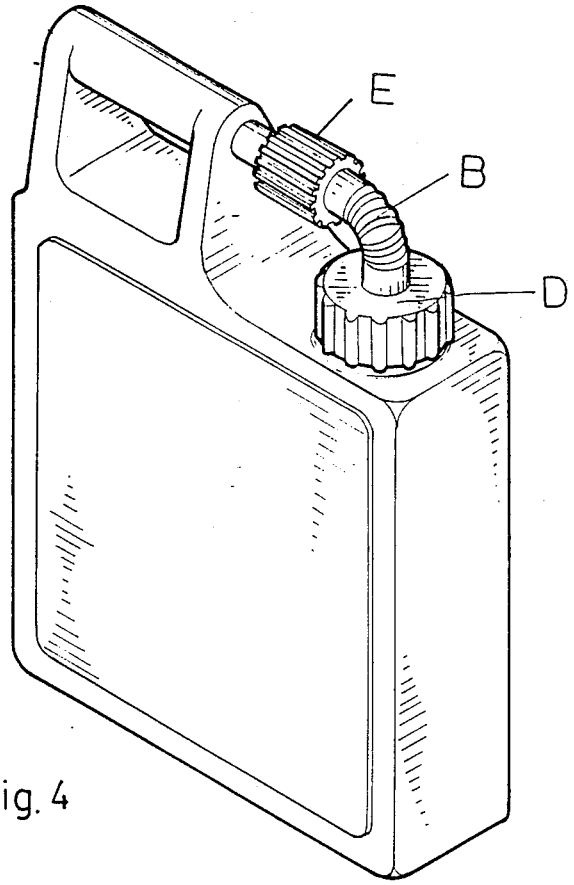
FIG. 4 is also an exploded perspective view of the improved liquid container in accordance with the present invention.
Figure 5:
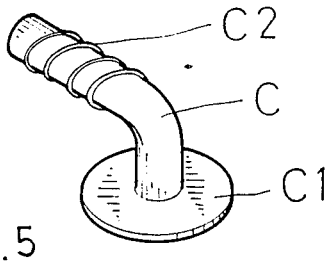

As shown in FIGS. 1, 2, 3, and 4, this liquid container comprises a round opening A for filling in or pouring out liquid, a flexible duct B or a rotary duct C having a female screw thread at the upper end and a round plate B1 at the lower end, a big coupling cap D having a central round hole for the flexible duct B to penetrate through upward and male screw thread to match with the male screw thread of the opening to cover the opening A, an air hole F extending horizontally from the handle for air to flow in or out of the container, and a small coupling cap E for covering the air hole F having a female screw thread at the other end to match with the male screw thread of the flexible duct B. The round plate B1 is to keep the big coupling cap D on the flexible duct when said duct is separated from the opening A. When the small coupling cap E covering the air hole is connected with the flexible duct B and the big coupling cap D is connected with the opening A, the opening A communicates with the air hole F.

When a liquid is to be filled in this container, the small coupling cap E is to be kept covering the air hole F and connected with the flexible duct B, but the big coupling cap is removed from the opening A, so the liquid can be poured into the container through the opening A. After the container is filled with the liquid, the big coupling cap D is turned to cover the opening A again. Then the opening A communicates with the air hole F through the big coupling cap D, the flexible duct B and the small coupling cap E, so the liquid can flow around through those parts A, B, E, F even if the container is tilted or turned over. Therefore the liquid does not leak out of the container.

In case the liquid in the container is to be poured out, the flexible duct B is to be separated from the small coupling cap E but the big coupling cap D is to be kept connected with the opening A. Then the liquid in the container can be poured out through the upper end of the flexible duct B, which can be bent to any direction. Moreover, flowing out of the liquid can never be intermittent as a common conventional container, as the air outside can flow through the air hole F into the container balancing the pressures inside and outside. In addition, the big coupling cap D will never be lost or contaminated as it is always kept on the flexible duct B when it is separated from the opening A.

What is claimed is:

1. A liquid container comprising a container body, the container body having a handle, a first opening into the container body for filling and pouring out of liquid, a second opening into the container body defined in the container handle for serving as an air hole;

a liquid transmitting duct removably positionable at the first opening for communicating into the first opening, and a bottom plate on the duct for positioning of the duct, the duct projecting above the bottom plate;

a first coupling cap emplaceable over the first opening for closing the first opening, the first coupling cap having a third opening through it through which the duct is passed, and the first coupling cap and the bottom plate on the duct being so shaped that the plate engages in the first coupling cap for retaining the duct projecting through the third opening; means on the first coupling cap for being secured to the container over the first opening for completing a liquid connection from the container through the first opening into the duct; the duct being adapted for being moved in various directions;

connection means at the second opening and also separably connectable with the duct for making a connection between the duct and the air hole for preventing leakage out of the container through the duct and the air hole, and the duct being separable from the connection means at the second opening for enabling liquid to be poured from the container through the duct and for enabling air to enter the container through the air hole.

2. The liquid container of claim 1, wherein the handle is so oriented and the second opening is so located that the air hole opens horizontally from the handle.

3. The liquid container of claim 1, wherein the first opening is defined by an upstanding, male threaded element and the first coupling cap includes a female thread for being tightened on the male thread at the first opening, and the duct bottom plate is disposed beneath the first coupling cap.

4. The liquid container of claim 1, further comprising a second coupling cap at the second opening and means on the second coupling cap for separably connecting the second coupling cap to the duct for completing the pathway from the duct through the second coupling cap to the air hole of the second opening.

5. The liquid container of claim 4, wherein the second coupling cap is relatively rotatable with respect to the handle and around the second opening; the duct is externally threaded while the second coupling cap is cooperatingly internally threaded to the thread on the duct, such that rotation of the second coupling cap selectively secures the duct to the second coupling cap and separates the connection therebetween; the second coupling cap and the container being so shaped that the second coupling cap remains with the container when the duct is separated from the second coupling cap.

6. The liquid container of claim 4, wherein the first coupling cap is larger in diameter over the first opening than the duct as the duct passes through it and larger in diameter than the second coupling over the second opening.

7. The container of claim 1, wherein the duct is a flexible duct, bendable to enable the duct to move in various directions.

8. The liquid container of claim 1, wherein the duct is rotatable around the opening to enable the duct to move in various directions.

* * * * *